US006811644B2

(12) United States Patent
Brandt et al.

(10) Patent No.: US 6,811,644 B2
(45) **Date of Patent: *Nov. 2, 2004**

(54) PROCESS AND APPARATUS FOR DECORATING PACKAGES WITH CONVEX SURFACES

(75) Inventors: Thomas L. Brandt, Windsor, NY (US); Daniel N. Wilkens, Myrtle Beach, SC (US); Neal D. Turner, Brackney, PA (US); Harold N. Turner, Brackney, PA (US)

(73) Assignee: Heineken Technical Services, B.V., Zoeterwoude (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/974,809

(22) Filed: Oct. 12, 2001

(65) Prior Publication Data

US 2003/0015297 A1 Jan. 23, 2003

(Under 37 CFR 1.47)

Related U.S. Application Data

(60) Continuation of application No. 09/799,357, filed on Mar. 6, 2001, now abandoned, which is a continuation of application No. 09/634,644, filed on Aug. 8, 2000, now abandoned, which is a division of application No. 08/930,464, filed as application No. PCT/DE96/00365 on Mar. 2, 1996, now Pat. No. 6,098,689.

(30) Foreign Application Priority Data

Mar. 18, 1995 (DE) ..... 195 09 984

(51) Int. Cl.[7] ..... B44C 1/17; B65C 3/16; B65C 9/04; B65C 9/36; B65C 9/25

(52) U.S. Cl. ..... 156/230; 156/238; 156/240; 156/247; 156/289; 156/540; 156/556; 156/567; 156/580; 156/583.1; 156/DIG. 13; 156/DIG. 36

(58) Field of Search ..... 156/230, 238, 156/240, 247, 277, 289, 446, 447, 458, 540, 567, 556, 580, 583.1, 583.8, 205, 470, 358, DIG. 26, DIG. 13, DIG. 21, DIG. 18, DIG. 36

(56) References Cited

U.S. PATENT DOCUMENTS

| | | | | |
|---|---|---|---|---|
| 2,674,299 A | | 4/1954 | Bruker | |
| 3,616,073 A | | 10/1971 | McGirr | |
| 4,806,197 A | * | 2/1989 | Harvey | 156/449 |
| 5,147,495 A | | 9/1992 | Douglas | |
| 5,156,714 A | | 10/1992 | Thomas | |
| 5,571,368 A | | 11/1996 | Barge | |
| 5,650,037 A | | 7/1997 | Larson | |
| 5,709,770 A | | 1/1998 | Asghar et al. | |
| 5,735,996 A | | 4/1998 | Asghar et al. | |
| 6,098,689 A | * | 8/2000 | Fiwek | 156/540 |

FOREIGN PATENT DOCUMENTS

| | | |
|---|---|---|
| DE | 32 40 041 | 5/1984 |
| EP | 0 183 440 | 6/1986 |
| EP | 0 511 605 | 4/1992 |
| WO | WO 94/05515 | 3/1994 |
| WO | WO 96/09966 | 4/1996 |

OTHER PUBLICATIONS

Derwent Abstract for DE 32 41 041.

Derwent Abstract for EP 0 511 605.

European Search Report of Corresponding Application, PCT/DE/96/00365 of Jul. 4, 1996.

* cited by examiner

*Primary Examiner*—Jerry A. Lorengo
(74) *Attorney, Agent, or Firm*—Young & Thompson

(57) ABSTRACT

The purpose is to simplify the heat transfer process and extend the performance range of the corresponding installations. The purpose is achieved by arranging for opposite movements of the conveyor (4) with the cylindrical packings (5) and those of the conveyor (7, 7') with the decoration, rotating the objects (5) by means of the movement of the conveyor (7, 7') and applying the necessary heat to the conveyor (7, 7'). Such processes and devices are used in the foodstuffs and beverages industry among others to decorate cylindrical packings of different materials.

18 Claims, 4 Drawing Sheets

PROCESS AND APPARATUS FOR DECORATING PACKAGES WITH CONVEX SURFACES

RELATED APPLICATIONS

Figure 1:
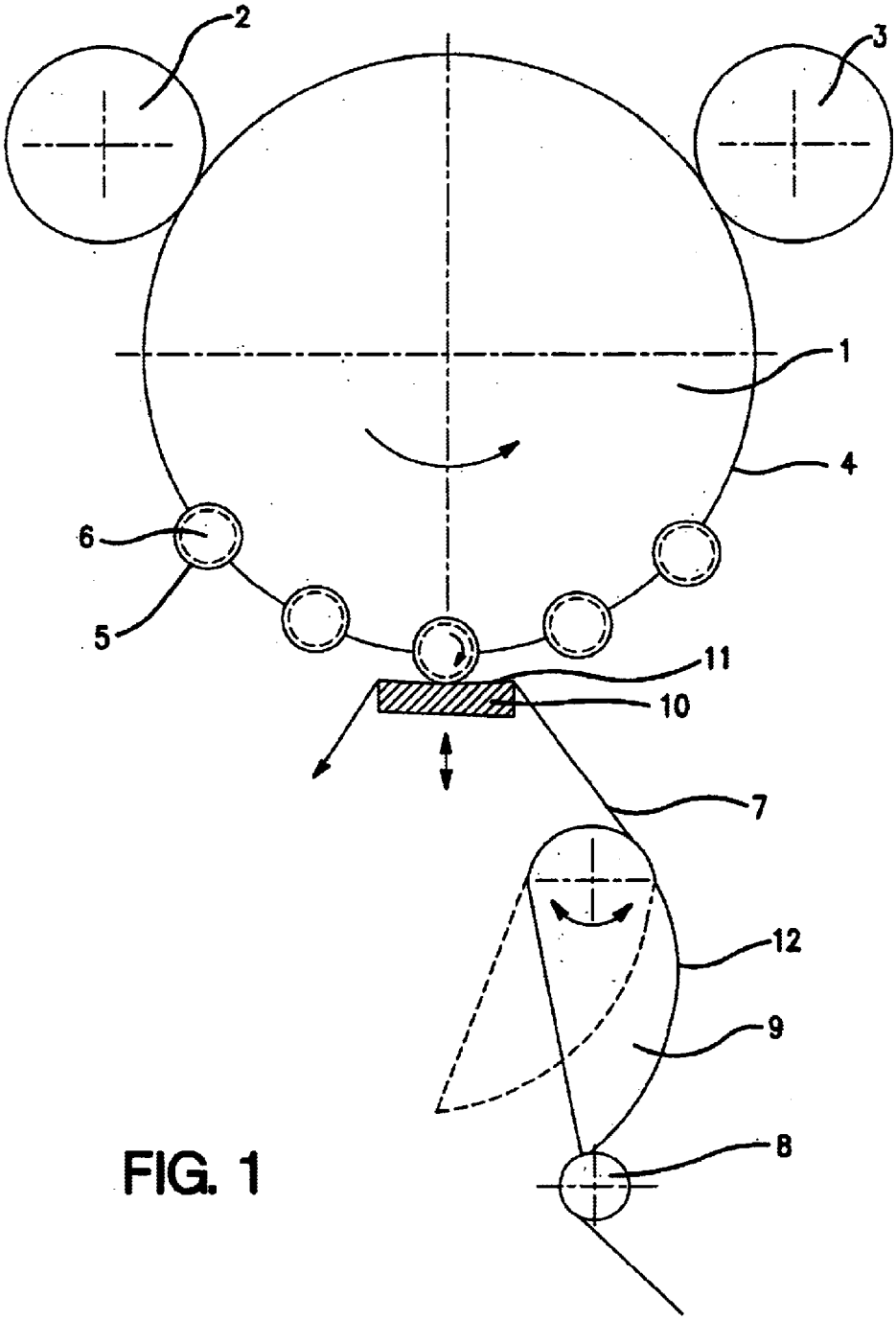

This application is a continuation of application Ser. No. 09/799,357, filed on Mar. 6, 2001, now abandoned, which is a continuation of Ser. No. 09/634,644, filed Aug. 8, 2000, now abandoned, which is a division of application Ser. No. 08/930,464; filed Dec. 5, 1997, now U.S. Pat. No. 6,098,689, issued Aug. 8, 2000, which is the national phase of PCT International application Ser. No. PCT/DE96/00365 filed on Mar. 2, 1996 under 35 U.S.C. §371, which claimed priority of DE 195 09984, filed Mar. 18, 1995. The entire contents of each of the above-identified applications are hereby incorporated by reference.

The invention relates to a continuous process wherein the packages are moved on a transport conveyor with a superimposed autorotation and the decorations are moved on a carrier conveyor tangentially past a transfer location with constant velocities, wherein at the transfer location the decorations are sequentially transferred to the packages through the application of pressure and heat.

The invention also relates to a corresponding apparatus having a driveable continuous transport conveyor with equally spaced, driveable and rotating receiving means for the packages, a driveable continuous carrier conveyor with equally spaced decorations, and a contact region between the transport conveyor and the carrier conveyor forming a transfer location, wherein there are disposed in the region of the transfer location means for applying pressure and means for heating the decoration.

Processes and apparatus of this type are used, for example, in the food and beverage industry for decorating packages made from paper, plastic, glass or metal.

The thermal transfer process is, for various reasons, rapidly emerging as the dominant process for decorating packages in the manner described above, overtaking other processes, for example labeling processes.

The decoration motif is pressed onto a carrier conveyor through conventional pressure techniques in such a way that the motif is attached to the carrier conveyor through an adhesive means with a smaller adhesive force and covered with another adhesive means with a larger adhesive force. A carrier conveyor set up in this fashion is brought in contact with the packages to be decorated. By applying pressure and heat in this contact region, the decoration is released from the transport conveyor and simultaneously bonded to the package. Heat is hereby supplied through the package.

This process can consequently only be used with packages with a large heat capacity, such as glass bottles.

A continuous process and an apparatus therefor, wherein the thermal transfer process can also be used for packages with a smaller heat capacity, for example plastic packages, are described in DE 44 37 379.1. Herein, the carrier conveyor is separated into individual sections, with each section carrying one print motif, and transported to heated application segments which are arranged on an application transport means with equal spacing therebetween. The application transport means briefly captures the packages in such a way that one package is associated with each transport segment. The decoration is then transferred from the individual section to the package during the transport. This process, however, requires rather complex mechanisms due to the large number of discrete process steps.

In addition, it is difficult to coordinate the large number of individual movements of the feed screws for the packages, the application transport means for the packages and the application segments, the application segments, the packages, the continuous conveyor for the decorations and the cutting device. This coordination of the individual movements can only be accomplished with the help of a complex gear and cam control or implemented by employing corresponding electrical drives.

Moreover, the handling of the individual label segments limits the efficiency of the machine. It is particularly disadvantageous that the transfer of thermal energy into the label material cannot be adapted to the operating speed of the machine. As a result, the variable efficiency range of the machine is severely limited which adversely effects a turnkey production line. There is also the danger that the label material and thin-wall plastic packages can be thermally damaged at low speed.

The packages printed with the thermal transfer process generally require a heat post-treatment for rendering the transferred color image glossier, for allowing the dyes to dry, and for improving the adhesion of the backing.

For this purpose, it has been proposed in DE 44 27 870.5 to transport the freshly printed packages while the image is still wet, to a separate oven with the help of separate conveying means.

It is also known in the art to employ—instead of an oven—an open flame, in combination with a rotation of the packages. An open flame, however, puts severe demands on the equipment technology and, in addition, prevents the use of plastic packages since these may become deformed.

It is therefore the object to provide a process and an apparatus of the type described above which operates over a large variable operating range and is of simple design.

The object is solved by the process in that the transport conveyor and the carrier conveyor move in opposite directions, wherein the ratio of the spacing between the packages on the transport conveyor to the velocity of the transport conveyor is the same as the ratio of the spacing between the decorations on the carrier conveyor to the velocity of the carrier conveyor. Moreover, in the region of the transfer location, the package is adjusted to a circumferential velocity corresponding to the velocity of the carrier conveyor, while the required heat is applied to the carrier conveyor.

It is a particular advantage of the invention that the circumferential velocity of the packages is extremely high. This velocity is derived in a known fashion by adding the velocity of the transport conveyor to the velocity of the carrier conveyor; in this case, however, the velocities have to be added with the same sign.

The high circumferential velocity makes possible a continuous operation since the respective spacings between the packages on the transport conveyor and the respective spacings between the decorations on the carrier conveyor are now independent of each other. It is no longer necessary to cut the individual sections in order to match the carrier conveyor. In addition, the extremely short contact time also avoids a temperature transfer from the carrier conveyor to the package which is particularly advantageous with plastic packages. Furthermore, the two temperature-dependent adhesive layers on the carrier conveyor are not affected.

It is particularly advantageous if the packages are not driven separately, but through the movement of the carrier conveyor. The coordination between movements of the package and the carrier conveyor which is otherwise required, is thereby eliminated.

It is also advantageous if simultaneously with the package to be decorated, the subsequent package, as viewed in the direction of motion, is also driven by the carrier conveyor. The subsequent package thereby undergoes an acceleration phase, thus averting a difference in velocity between the package and the carrier conveyor during the transfer.

It is furthermore advantageous if the required heat is supplied to the carrier conveyor before or at the transfer location. In this way, the heat supply can be optimally metered and adjusted in close proximity to the transfer location, making possible an accurate calculation of the heat loss.

It is particularly advantageous if the heat-up time depends on the velocity of the carrier conveyor and if the control thereof is automatic.

This again aids the heat conduction and improves the quality of the transfer of the decoration. It is particularly advantageous if the freshly decorated packages move past a heat post-treatment unit for attaining a higher color luster. Here, the existing transport conveyor is advantageously employed for moving the packages past a stationary temperature-controlled heat source.

The object of the invention is also solved by an apparatus, wherein the drive means for the transport conveyor and the carrier conveyor are designed to enable opposing directions of movement and wherein a guide element for the carrier conveyor is adapted for applying pressure and for transferring heat. The guide element can move transversely to the direction of movement of the carrier conveyor, and is pre-loaded and formed as a heating element.

It is advantageous to construct the receiving means for the packages in such a way that they can rotate freely, and to drive the package to be decorated, or the package to be decorated and the subsequent package, with the help of the carrier conveyor.

It is also possible to use a separate conventional drive. In this case, means have to be employed for providing identical circumferential velocities. It is also possible to combine both drive options. A separate drive then generates a velocity on the package which is smaller than the required velocity, whereby the difference in velocities is made up by the carrier conveyor. In this case, the separate drive has to be equipped with an additional free-wheel.

In a practical embodiment, the guide element is preceded by a moveable heating element. By changing the position of the heating element, the size of the contact surface between the heating element and the carrier conveyor can be continuously adjusted between zero and a maximum value. In this manner, the heat-up time can advantageously be matched to the velocity of the carrier conveyor.

The convex shape of the guide surface of the heating element increases the contactability and improves the heat transfer.

The heating element is advantageously adapted for pivotal movement.

It is furthermore advantageous to make the heating element stationary and to operably connect the heating element to a swivel arm. The swivel arm has a deflection roller for the carrier conveyor for adjusting the contact surface between the heating element and the carrier conveyor.

The heating element or the swivel arm can have their own actuating drive or can be driven by their weight if attached accordingly.

The corresponding control operation can be carried out automatically.

The heating element can also be constructed from two parts. The moveable heating element then functions as a pre-heater, whereas the pressure head functions as the actual heating element.

Special attention has to be paid to a selected heat post-treatment of the decoration, so that the colors can be provided with a high degree of luster and the adhesion to the base is improved. These requirements are essentially met by a stationary and electrically powered hot plate or a stationary hot air gun. With both devices, the existing transport conveyor of the carousel is advantageously used for transporting the packages. The time of the heat post-treatment can be uniquely specified from the length of the active heating surface and the velocity of the transport conveyor.

The invention will now be discussed with reference to an embodiment.

Figure 2:
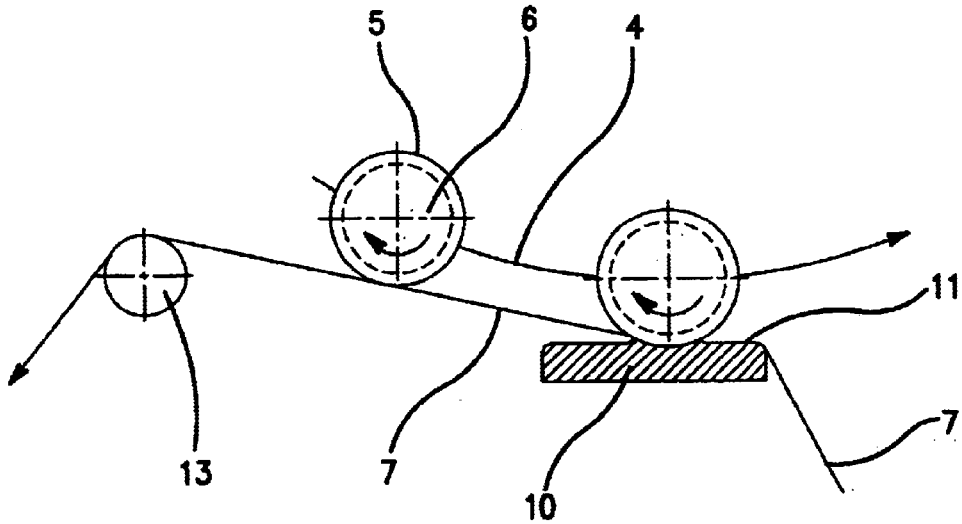
Figure 3:
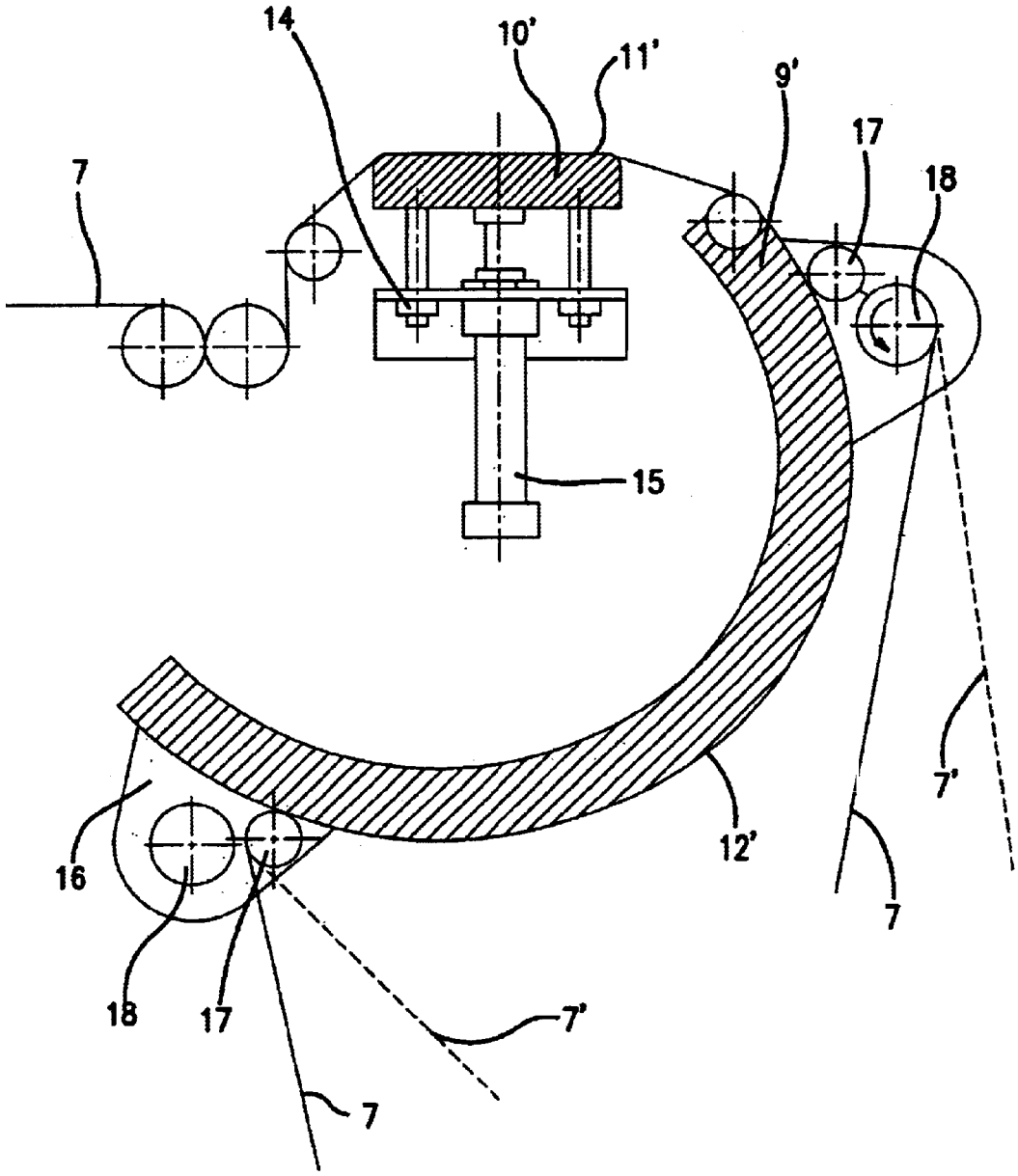
Figure 4:
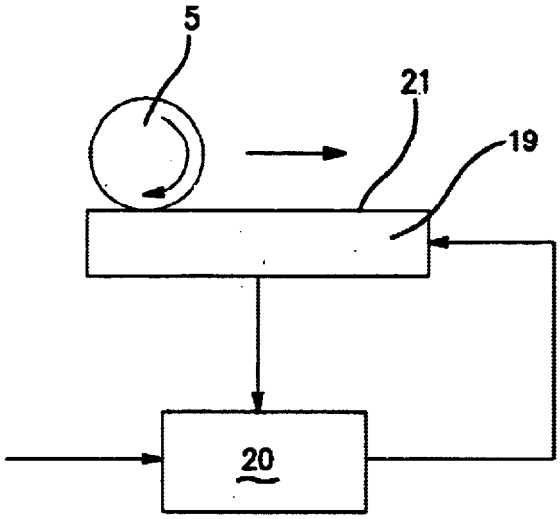
Figure 5:
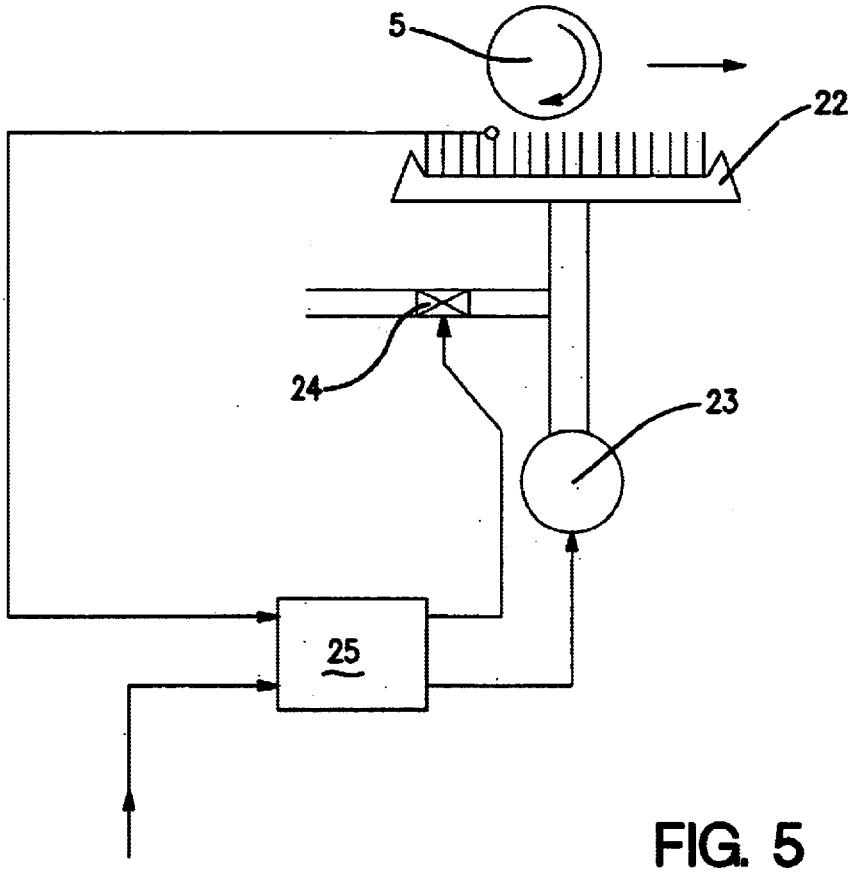

It is shown in:

FIG. 1 a schematic top view of the apparatus for decorating,

FIG. 2 a practical embodiment for driving the packages with the help of the carrier conveyor, FIG. 3 a practical embodiment for the heating unit of the carrier conveyor, FIG. 4 a heat post-treatment unit, and FIG. 5 a different heat post-treatment unit.

The apparatus for decorating includes mainly a transport unit for the packages and a transport unit for the decorations, wherein both have a common interface for transferring the decorations to the packages.

Referring now to FIG. 1, the transport unit for packages is constructed as a rotatable carousel 1. The carousel 1 is provided with a drive (not shown), an input station 2, an output station 3 and a transport conveyor 4 for the packages 5. On the transport conveyor 4, there are arranged receiving means 6 with substantially equal distances therebetween for receiving the packages 5 to be decorated. These receiving means 6 are designed to rotate freely.

The transport unit for the decorations includes a carrier conveyor 7 which is pulled under tension by a drive (not shown), and a corresponding guide element for this carrier conveyor 7. The carrier conveyor 7 is constructed in a conventional manner and carries—with the help of an adhesive with a smaller adhesion force—decorations arranged With substantially equal distance therebetween. The top surfaces of the decorations are coated with a different adhesive having a greater adhesion force.

The guide elements have at least one deflection roller 8, a pivoted heating element 9 and a pressure bead 10 which is moveable in the direction of the packages 5. The pivoted heating element 9 has an outer guide surface 12 with a preferably convex shape, and an upper pivot. The heating element 9 can be pivoted about this pivot by a drive of conventional design in the direction transverse to the direction of movement of the carrier conveyor 7. This resulting contact surface between the guide surface 12 and the carrier conveyor 7 changes its size depending on the pivoting angle. The pressure head 10 also has an outer, preferably flat guide surface 11 and is driven in the direction of the carousel 1 by a preloaded compression spring or by another conventional drive system. The transport conveyor 4 for the packages 5 and the carrier conveyor 7 for the decorations are oriented tangentially with respect to each other in the region of the pressure head 10, whereby the movement of the transport conveyor 4 is opposite to that of the carrier conveyor 7. Consequently, the carrier conveyor 7 and the packages 5 directly contact each other and thereby also the freely rotatable receiving means 6 in these regions.

As depicted in FIG. 2, in a special arrangement, a deflection roller 13 can be disposed following the pressure head 10 in the direction of movement of the carrier conveyor 7. The deflection roller 13 is here located outside the transport conveyor 4 at a distance from the pressure head 10 which is larger than the distance between the packages 5, thereby enabling contact between the carrier conveyor 7 from which the decoration was removed, and the following package 5.

Referring now to FIG. 3, the guide element for the carrier conveyor 7 is formed of the pressure head 10' and the heating element 9'. The distance between the pressure head 10' and the heating element 9' is fixed. The pressure head 10' has an outer guide surface 11', a mechanical preset unit 14 and a pneumatic drive 15.

The heating element 9' is provided with an outer convex guide plane 12' and is operably connected with a swivel arm 16. The head of this swivel arm 16 is provided with a deflection roller 17 and with a spacer roller 18. The swivel arm 16 furthermore includes a drive (not shown) for changing the position of the deflection roller 17 with respect to the heating element 9'. This position is set depending on the velocity of the carrier conveyor 7 and determines the size of the contact surface between the heating element 9' and the carrier conveyor 7. At a slow velocity, the deflection roller 17 is positioned closer to the pressure head 10', moving away from the pressure head 10' at a higher velocity. The spacer roller 18 keeps the carrier conveyor 7 away from the heating element 9' in the region before the deflection roller 17.

The carrier conveyor 7' is shown the position when the roller with the carrier conveyor 7 has rolled off.

The heat post-treatment unit which is depicted in FIG. 4, includes a stationary, electrically powered hot plate 19 and a controller 20 which can be set to a nominal temperature. The hot plate 19 can be provided with a flat or with a concave hot surface 21, depending if the transport direction of the packages 5 follows a linear or a circular path. For example, if the transport conveyor 4 of the carousel 1 is also used for the heat post-treatment of the packages 5, then a hot surface 21 with a concave shape is advantageous. After a suitable shape of the hot surface 21 has been selected, a certain heat post-treatment time can be defined depending on the length or the hot surface 21.

For the purpose of driving the rotation of the packages 5, the existing friction between the moving packages 5 and the stationary hot plate is once again preferably utilized.

A heat post-treatment unit of the type depicted in FIG. 5 primarily includes a nozzle 22, a temperature-controlled hot air generator 23, a volume-controlled bypass valve 24 and a temperature and volume controller 25.

The packages 5 are again located on a linear or circular path. A separate drive is required for rotating the packages 5.

The material of the packages 5 has to be taken into consideration when the nominal temperature setting for the controller 20 or for the temperature and volume controller 25 is specified. Special attention has to be paid to packages 5 made of plastic. In order to prevent packages 5 made of plastic from being deformed, it may be appropriate to stabilize such plastic packages 5 with blown-in compressed air.

The operation of the apparatus will now be described with reference to FIG. 1.

The carousel 1 and the carrier conveyor 7 are each driven with a selected, but constant velocity, with the carousel 1 and the carrier conveyor 7 moving in opposite directions. The packages 5 placed onto the receiving means 6 by the input station 2 are transported on the transport conveyor 4 in the direction of the pressure head 10. Simultaneously, the decorations which have been heated to the desired temperature at the heating element 9, move in the opposite direction towards the pressure head 10.

Through the contact which is created between each package 5 and the carrier conveyor 7 in the region of the pressure head 10, the package 5 which can rotate freely on the receiving means 6, begins to rotate. Hereby, a circumferential velocity is established on the package 5 which has the same magnitude as the velocity of the carrier conveyor 7. The package 5 rolls on the carrier conveyor 7 under the influence of the pressure exerted by the pressure head 10. As a result, the decoration is released from the carrier conveyor and adheres to the package 5.

The packages 5 subsequently pass through one of the heat post-treatment units.

List of Reference Numbers

| | |
|---|---|
| 1 | Carousel |
| 2 | Input station |
| 3 | Output station |
| 4 | Transport conveyor |
| 5 | Cylindrical packing |
| 6 | Receiving means |
| 7, 7' | Carrier conveyor |
| 8 | Deflection roller |
| 9, 9' | Heating element |
| 10, 10' | Pressure head |
| 11, 11' | Guide surface of the pressure head |
| 12, 12' | Guide surface of the heating element |
| 13 | Deflection roller |
| 14 | Preset unit |
| 15 | Pneumatic drive |
| 16 | Swivel arm |
| 17 | Deflection roller |
| 18 | Spacer roller |
| 19 | Hot plate |
| 20 | Controller |
| 21 | Hot surface |
| 22 | Nozzle |
| 23 | Hot air generator |
| 24 | Bypass valve |
| 25 | Temperature and volume controller |

What is claimed is:

1. A process for continuously placing decorations on packages having convex surfaces, the packages being rotatably supplied on a transport conveyor and the decorations being moved on a carrier web extending from a supply reel to a take up reel, tangentially past a transfer location, the decorations being sequentially transferred under the application of heat and/or pressure, the method further comprising the steps of:

rotating the packages at a circumferential velocity corresponding with the carrier web speed in the region of the transfer location, and moving the transport conveyor and the carrier web in opposite directions.

2. The process according to claim 1, the carrier web comprising image transfer decorations.

3. The process according to claim 1, wherein a ratio of spacing between the packages on the transport conveyor to the velocity of the transport conveyor, is maintained the same as the ratio of the spacing between the decorations on the carrier web to the velocity of the carrier web.

4. The process according to claim 1, wherein the rotation of the packages is driven by the movement of the carrier web.

5. The process according to claim 4 wherein each package is already accelerated by the carrier web before reaching the transfer location.

6. The process according to claim 1, wherein heat is supplied to the carrier web before or at the transfer location.

7. The process according to claim 6, wherein a heat-up time of the carrier web depends on the velocity of the carrier web.

8. The process according to claim 7, wherein a heat-up time of the carrier web is controlled automatically.

9. The process according to claim 1, wherein the packages are made of plastic and are stabilized by blown-in compressed air.

10. An apparatus for continuously decorating packages with convex surfaces, comprising:

a drivable transport conveyer with uniformly spaced rotatable receivers for the packages, a storage reel and a take up reel and drive equipment for operating at least one of said reels for supplying a continuous carrier web of uniformly spaced decorations past a contact region, the contact region forming a transfer location, and a pressure applying device that urges the decorations on the carrier web in the direction of the packages, the drive equipment for the transport conveyor and the reels being designed for opposite directions of movement of the carrier web and the transport conveyor at the contact region.

11. Apparatus according to claim 10, the pressure applying device being formed by a guide element, which is movable transversely to the direction of movement of the carrier web.

12. Apparatus according to claim 10, wherein the receivers for the packages are designed to rotate freely and wherein each receiver can be driven by the carrier web via the packages.

13. Apparatus according to claim 10, wherein the receivers for the packages comprise a separate drive.

14. Apparatus according to claim 10, wherein the receivers comprise a separate drive for providing a velocity which is less than a transfer velocity, and that the transfer velocity is generated through contact between the packages and the carrier web.

15. Apparatus according to claim 10, wherein the pressure applying device is preceded by a moveable heating element with a contact surface, wherein the size of the contact surface between the heating element and the carrier web can be adjusted continuously between zero and a maximum value.

16. Apparatus according to claim 15, wherein the contact surface of the heating element has a convex shape.

17. Apparatus according to claim 10, further comprising a post-treatment unit having an electrically powered hot plate with a flat or concave hot surface and a controller which is adjustable to a nominal temperature.

18. Apparatus according to claim 17, wherein the flat hot surface (21) relates to a linear transport conveyor and the concave hot surface (21) relates to a circular transport conveyor for the packages (5) and that the length of the effective hot surface (21) is specified for a nominal post-heat-treatment time.

* * * * *